US011383874B2

(12) United States Patent
Wen et al.

(10) Patent No.: US 11,383,874 B2
(45) Date of Patent: Jul. 12, 2022

(54) ROBOTIC LABELING SYSTEM AND METHOD OF LABELING PACKAGES

(71) Applicant: TE Connectivity Services GmbH, Schaffhausen (CH)

(72) Inventors: Du Wen, Reading, PA (US); Jiankun Zhou, Middletown, PA (US); Swapnilsinh Solanki, Harrisburg, PA (US); Xinping Deng, Lancaster, PA (US); Roberto Francisco-Yi Lu, Bellevue, WA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 17/037,905

(22) Filed: Sep. 30, 2020

(65) Prior Publication Data

US 2022/0097889 A1 Mar. 31, 2022

(51) Int. Cl.
*B65C 9/06* (2006.01)
*B65C 9/26* (2006.01)
(Continued)

(52) U.S. Cl.
CPC ..... *B65C 9/06* (2013.01); *B65C 9/04* (2013.01); *B65C 9/26* (2013.01); *B65C 9/40* (2013.01);
(Continued)

(58) Field of Classification Search
CPC .. B65C 1/021; B65C 9/02; B65C 9/04; B65C 9/06; B65C 9/26; B65C 9/40; B65C 9/44;
(Continued)

(56) References Cited

U.S. PATENT DOCUMENTS

2007/0126578 A1* 6/2007 Broussard ..... G06Q 10/087 340/572.1
2016/0052659 A1* 2/2016 Bowers ..... B65C 1/021 156/64

(Continued)

FOREIGN PATENT DOCUMENTS

JP 06024428 A * 2/1994
JP 2005280911 A * 10/2005
JP 2006082811 A * 3/2006

OTHER PUBLICATIONS

Translation of JP-06024428-A, Feb. 1994, Fujii, Koji (Year: 1994).*

(Continued)

*Primary Examiner* — George R Koch

(57) ABSTRACT

A robotic labeling system for labeling packages on a pallet includes a depalletizing station having a pallet holding a plurality of unlabeled packages and a palletizing station having a pallet configured to receive a plurality of labeled packaged. The robotic labeling system includes a labeling station configured to successively receive the packages for labeling. The labeling station has a labeling device preparing labels for the packages and a label applicator moving the labels from the labeling device to the corresponding packages. The labeling station includes a label verification scanning device scanning the applied labels for label verification. The robotic labeling system includes a palletizing robot moving the unlabeled packages from the depalletizing station to the labeling station for label application and moving the labeled packages from the labeling station to the palletizing station after label verification.

22 Claims, 6 Drawing Sheets

(51) Int. Cl.
*B65C 9/04* (2006.01)
*B65C 9/40* (2006.01)

(52) U.S. Cl.
CPC .. *B65C 2009/407* (2013.01); *B65C 2009/408* (2013.01)

(58) Field of Classification Search
CPC ..... B65C 9/46; B65C 2009/401; B65C 2009/407; B65C 2009/408
See application file for complete search history.

(56) References Cited

U.S. PATENT DOCUMENTS

2016/0063770 A1* 3/2016 Bowers ..... B07C 3/14
156/64
2018/0221244 A1* 8/2018 Joplin ..... B65B 61/20

OTHER PUBLICATIONS

Translation of JP-2006082811-A, Mar. 2006, Tatsumi, Fumiaki (Year: 2006).*
Translation of JP-2005280911-A, Oct. 2005, Tatsumi, Fumiaki (Year: 2005).*

* cited by examiner

ROBOTIC LABELING SYSTEM AND METHOD OF LABELING PACKAGES

BACKGROUND OF THE INVENTION

The subject matter herein relates generally to package labeling systems and methods.

Package labeling is a manual process at many warehouses and distribution centers. The manual labeling process relies on operators to determine the location where the labels need to be applied. Manual labeling processes have high labor costs, are subject to human error, and are time consuming to apply the labels. Additionally, labels applied manually to packages may be at improper or unwanted positions and may be applied inconsistently from package to package. Some known automated labeling systems are in use in warehouses and distribution centers. However, conventional labeling systems use simple labeling methods to apply the labels to the packages. For example, the conventional labeling systems use a single axis arm attached to a printer to apply the label to the box. The label is always applied to the same side of the box. The box is required to have a particular orientation relative to the printer and the label applicator. Known automated labeling systems do not tend to accommodate different sized packages.

Some packages are arranged on pallets for shipping. However, the packages need to be removed from the pallets, labeled, and then restacked on the pallets for further processing or shipping. The removal, labeling and restacking processes are labor intensive.

A need remains for a dynamic, automated labeling system for labeling and palletizing packages.

BRIEF DESCRIPTION OF THE INVENTION

In one embodiment, a robotic labeling system for labeling packages on a pallet is provided. The robotic labeling system includes a depalletizing station having a space for a pallet holding a plurality of unlabeled packages. The robotic labeling system includes a palletizing station having a space for a pallet configured to receive a plurality of labeled packaged. The robotic labeling system includes a labeling station adjacent to the depalletizing station and the palletizing station. The labeling station is configured to successively receive the packages for labeling. The labeling station has a labeling device preparing labels for the packages and a label applicator moving the labels from the labeling device to the corresponding packages. The labeling station includes a label verification scanning device scanning the applied labels for label verification. The robotic labeling system includes a palletizing robot moving the unlabeled packages from the depalletizing station to the labeling station for label application and moving the labeled packages from the labeling station to the palletizing station after label verification.

In another embodiment, a robotic labeling system for labeling packages on a pallet is provided. The robotic labeling system includes a depalletizing station having a space for a pallet holding a plurality of unlabeled packages. The robotic labeling system includes a palletizing station having a space for a pallet configured to receive a plurality of labeled packages. The robotic labeling system includes a labeling station adjacent to the depalletizing station and the palletizing station. The labeling station is configured to successively receive each package for labeling. The labeling station includes a package identification system having a scanning device configured to scan an identification tag on the package to determine a package identification of the package and an orientation of the package in the labeling station. The labeling station includes a label application system having a labeling device and a label applicator. The labeling device preparing a label for the package based on the package identification. The label applicator applies the label to the package based on the package orientation. The labeling station includes a label verification scanning device scanning the applied label for label verification. The robotic labeling system includes a palletizing robot moving the unlabeled packages from the depalletizing station to the labeling station for label application and moving the labeled packages from the labeling station to the palletizing station after label verification.

In a further embodiment, a method of labeling packages on a pallet is provided. The method includes loading a pallet in a depalletizing station. The pallet holds a plurality of unlabeled packages. The method scans the pallet and the unlabeled packages at the depalletizing station using a depalletizing scanning device and successively retrieves the unlabeled packages from the depalletizing station using a palletizing robot. The method moves the unlabeled packages from the depalletizing station to a labeling station adjacent the depalletizing station and scans an identification tag on the package using a scanning device to determine a package identification of the package and an orientation of the package in the labeling station. The method includes preparing a label at a labeling device for the package based on the package identification and applies the label using a label applicator based on the package orientation in the labeling station. The method scans the applied label using a label verification scanning device to verify proper application of the label and moves the labeled package from the labeling station to a pallet at a palletizing station adjacent to the labeling station after label verification.

DETAILED DESCRIPTION OF THE INVENTION

Figure 1:
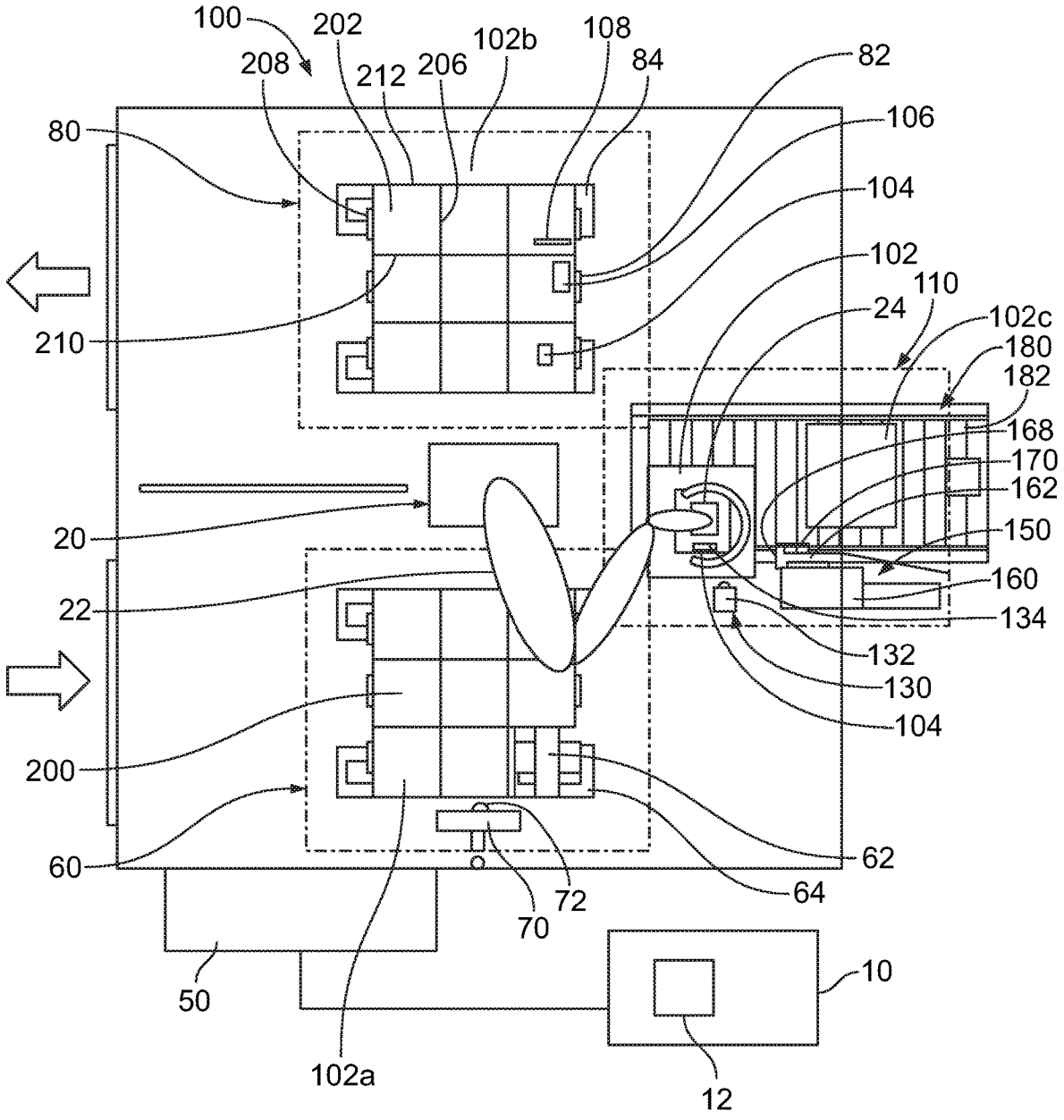
FIG. 1 illustrates a robotic labeling system in accordance with an exemplary embodiment.

FIG. 1 illustrates a robotic labeling system 100 in accordance with an exemplary embodiment. The robotic labeling system 100 is an automated system used for labeling packages 102. The robotic labeling system 100 is integrated with a package database management system 10, such as a warehouse management system (WMS). The package database management system 10 includes a package database 12 storing data related to the packages 102, such as for storing the packages 102, palletizing the packages 102, moving the packages 102 within the warehouse, processing the packages 102, labeling the packages 102, shipping the packages 102, and the like. The robotic labeling system 100 includes a controller 50 controlling operation of components of the robotic labeling system 100. The controller 50 is communicatively coupled to the package database management system 10 to send and receive data and/or control signals for controlling operation of the robotic labeling system 100. The robotic labeling system 100 is operated based on data from the package database management system 10. In an exemplary embodiment, the robotic labeling system 100 utilizes one or more robots for applying one or more labels on the packages 102. The robotic labeling system 100 uses intelligent control algorithms to apply the label(s). The robotic labeling system 100 scans the labels after application to verify proper application of the label(s) to the package 102 before palletizing the package 102.

The robotic labeling system 100 includes a palletizing robot 20 used for moving the packages 102 to and from a labeling station 110. The palletizing robot 20 is operably coupled to the controller 50, which controls movement and operation of the palletizing robot 20. Labels are applied to the packages 102 at the labeling station 110 using a label application system 150. The label application system 150 is operably coupled to the controller 50, which controls movement and operation of the components of the label application system 150. In various embodiments, the label application system 150 may apply multiple labels to each package 102, such as to various sides of the package 102.

In an exemplary embodiment, the palletizing robot 20 is a multi-axis robot having an articulating arm 22 that moves in three-dimensional space. An end effector 24 is provided at the end of the arm 22 to pick up the packages 102 and move the packages 102 to and from the labeling station 110. In various embodiments, the end effector 24 may be a vacuum end effector using suction to hold the package 102 on the end effector 24. Other types of end effectors may be used in alternative embodiments, such as a gripper. Other types of palletizing robots 20 may be used in alternative embodiments to manipulate and move the packages 102. In an exemplary embodiment, the palletizing robot 20 is configured to move the packages 120 among the palletizing station 80, the labeling station 110 and the de-palletizing station 60 as needed.

The palletizing robot 20 moves the packages 102 from a depalletizing station 60 to the labeling station 110 and then moves the packages 102 from the labeling station 110 to a palletizing station 80. Unlabeled packages 102*a* are unstacked from a pallet 62 at the depalletizing station 60 and the labeled packages 102*b* are restacked on a different pallet 82 at the palletizing station 80. In an exemplary embodiment, defective packages 102*c* are rejected from the labeling station 110 rather than moved to the pallet 82 at the palletizing station 80. For example, a label verification process may be performed at the labeling station 110 to confirm that the labels are properly applied to the packages 102 prior to restacking the packages 102 at the palletizing station 80. The rejected packages 102*c* may be further processed at a different processing station (not shown). The defective packages 102*c* may be packages that do not have identification tags to be checked by the system. The defective packages 102*c* may be packages with identification tags of which corresponding information is not found in the system. The defective packages 102*c* may be packages on which the label(s) were not applied properly, or the scanning device failed to read the applied label.

In an exemplary embodiment, the robotic labeling system 100 includes a rack 64 at the depalletizing station 60. The pallet 62, with the unlabeled packages 102*a*, is loaded onto the rack 64. For example, the pallet 62 may be delivered by a handcart, a forklift, an automated guided vehicle, a conveyor or other device. The rack 64 is located adjacent to the labeling station 110 such that the unlabeled packages 102*a* may be easily moved from the depalletizing station 60 to the labeling station 110 by the palletizing robot 20. The palletizing robot 20 is located adjacent to the depalletizing station 60 and the labeling station 110. For example, the palletizing robot 20 and/or the labeling station 110 may be located between the depalletizing station 60 and the palletizing station 80. In an exemplary embodiment, the palletizing station 80 includes a rack 84 that supports the pallet 82. During operation of the robotic labeling system 100, an empty pallet may be loaded onto the rack 84 at the palletizing station 80. The labeled packages 102*b* are stacked onto the empty pallet 82. Once the pallet 82 is full, the pallet 82 may be removed from the rack 84, such as by a handcart, a forklift, an automated guided vehicle, a conveyor or other device, and moved to a different processing station, such as a wrapping station where the stack of packages 102 are wrapped with plastic for loading into a truck for transportation from the warehouse. A new empty pallet may then be moved to the rack 84 for loading. In an exemplary embodiment, a palletizing program may be used to control positioning of the labeled packages 102*b* on the pallet 82. The palletizing robot 20 receives data from the palletizing program to control positioning of the labeled packages 102*b* on the pallet 82.

In an exemplary embodiment, the robotic labeling system 100 includes a depalletizing scanning device 70 at the depalletizing station 60. The depalletizing scanning device 70 may be a 3D vision system. In an exemplary embodiment, the depalletizing scanning device 70 identifies a size of each package 102 and a shape of each package 102. For example, the robotic labeling system 100 is capable of receiving different sized and shaped packages 102 and is capable of labeling such packages 102 by automatically determining the size and shape of the particular package 102 that is being processed at the labeling station 110. The depalletizing scanning device 70 is communicatively coupled to the controller 50 and sends data to the controller 50. In various embodiments, the depalletizing scanning device 70 may include one or more cameras 72. In various embodiments, the cameras 72 may be at fixed positions within the depalletizing station 60. In other various embodiments, the camera(s) 72 may be movable (for example, vertically and/or horizontally) to vary positioning of the camera(s) 72 to view the packages 102 from different angles. In an exemplary embodiment, the camera(s) 72 are configured to view multiple sides of the packages 102. The depalletizing scanning device 70 allows for vision inspection of the packages 102. For example, the controller 50 may perform vision inspection, such as to identify features of the packages 102 (for example, sides, edges, corners, and the like).

During use, the depalletizing scanning device 70 scans the unlabeled packages 102*a* on the pallet 62 in the depalletizing station 60. The palletizing robot 20 is operated based on the scan by the depalletizing scanning device 70. For example, the depalletizing scanning device 70 scans the locations of the packages 102 to control operation of the palletizing robot 20. Location data of each package 102 may be transmitted to the controller 50 to control the picking operation for the packages 102 by the palletizing robot 20. In an exemplary embodiment, the depalletizing scanning device 70 scans the dimensions of the packages 102 to control operation of the palletizing robot 20. Dimensional data of each package 102 may be transmitted to the controller 50 to control operations of the palletizing robot 20. For example, the dimensional data may be used to control the location where the palletizing robot 20 engages and picks up the package 102 (for example, the palletizing robot may be moved to pick up the package 102 at a center of one of the sides of the package 102). The dimensional data may be used by the controller 50 to control positioning of the package 102 in the labeling station 110, such as to control the position of the package 102 relative to the label application system 150.

The package 102 may be a box, such as a cardboard box, or other type of carton or container. In various embodiments, the package 102 may be parallelepiped having six sides 200, including a top side 202, a bottom side (not shown, but located opposite the top side 202), a front side 206, a rear side 208, a right side 210, and a left side 212. The package 102 may include additional sides 200 in alternative embodiments. The package 102 may have other shapes in alternative embodiments. In various embodiments, the sides 200 may be flat or planar. Alternatively, one or more of the sides 200 may be curved. In an exemplary embodiment, the sides 200 meet at corners and have edges extending between the corners. In various embodiments, one or more the sides 200 may be defined by panels meeting at seams. The panels may be taped at the seams.

In an exemplary embodiment, the package 102 includes an identification tag 104 at one of the sides 200. For example, the identification tag 104 may be a label applied to one of the sides 200. Alternatively, the identification tag 104 may be applied directly on one of the sides 200. The identification tag 104 is used to identify the particular package 102 (for example, compared to other packages 102). The identification tag 104 may be a unique identifier for the package 102. Information about the package 102 may be associated with the identification tag 104, such as data contained in the package database 12 of the package database management system 10. The identifying data about the package 102 may include content data relating to the contents of the package. The identifying data about the package 102 may include dimensional data relating to the height, width and length of the package. The identifying data may include shipping data relating to the package 102.

In various embodiments, the identification tag 104 is a scannable tag, such as a barcode, a data matrix, a QR code, or another type of symbolic scan code. The identification tag 104 may be used to track the package 102 within a warehouse, such as movement of the package 102 between various processing stations. In various embodiments, the identification tag 104 is applied to the package 102 outside of the labeling station 110. For example, the identification tag 104 may be applied to the package 102 prior to the package 102 being transported to the labeling station 110. The identification tag 104 may be applied to the package 102 when the package 102 is formed or when the package 102 is filled, such as at a packing station upstream of the labeling station 110. The identification tag 104 may be applied to any of the sides 200. In various embodiments, multiple identification tags 104 may be provided (for example, to avoid having the identification tag 104 on the bottom side 204 or the top side 202, and thus unviewable by the label application system 150 when presented at the labeling station 110).

In an exemplary embodiment, the package 102 receives a shipping label 106 at the labeling station 110. The shipping label 106 contains information about where the package 102 is being shipped. The shipping label 106 may include a name, an address, or other identifying data. In various embodiments, the shipping label 106 may include symbolic scan codes used for shipping. The shipping label 106 is applied to the package 102 by the label application system 150 at the labeling station 110. In an exemplary embodiment, the shipping label 106 is applied to any of the sides 200 that does not include the identification tag 104. In various embodiments, the label application system 150 does not apply any other labels to the side 200 that receives the shipping label 106.

In an exemplary embodiment, the package 102 receives one or more customer specified labels 108 at the labeling station 110. The customer specified label 108 or CSL 108 may contain information about the contents of the package 102 or other information. For example, the customer specified label 108 may contain information about the shipper of the package 102, the location of where the package 102 is being shipped from, return shipping information, warning labels regarding the package 102 or the content of the package 102, and the like. In various embodiments, the customer specified label 108 may include symbolic scan codes having data relating to the content of the package 102 or other information. The customer specified label 108 is applied to the package 102 by the label application system 150 at the labeling station 110. The customer specified label 108 may be applied to any of the sides 200 that do not include the identification tag 104. In various embodiments, the label application system 150 does not apply any other labels to the side 200 that receives the customer specified label 108. For example, the shipping label 106 is applied to a different side 200 than the customer specified label 108. Other types of labels may be applied to the package 102 in alternative embodiments.

In an exemplary embodiment, the robotic labeling system 100 includes a package identification system 130 for identifying the package 102 at the labeling station 110. The package identification system 130 includes a scanning device 132 for identifying the package 102. The scanning device 132 is operably coupled to the controller 50. Signals or data from the scanning device 132 may be transmitted to the controller 50 to control other operations of the robotic labeling system 100, such as the palletizing robot 20 and/or the label application system 150. In various embodiments, the scanning device 132 may include one or more cameras 134. The scanning device 132 is used to scan, and may image, the identification tag 104 to identify the package 102. The identification tag 104 may be a barcode and the scanning device 132 may be a barcode reader. In various embodiments, the scanning device 132 may image the package 102. The package 102 may be identified with reference to the package database 12. The package 102 is scanned to identify the package to control other operations, such as printing appropriate labels, for proper label application, and the like.

In an exemplary embodiment, the scanning device 132 identifies an orientation of the package 102 in the labeling station 110. The scanning device 132 may identify the side 200 of the package 102 that has the identification tag 104, which allows the robotic labeling system 100 to determine the orientation of the package 102. For example, the scanning device 132 may identify the top side 202 as having the identification tag 104 (top-side orientation); may identify the front side 206 is having the identification tag 104 (front-side orientation); may identify the rear side 208 as having the identification tag 104 (rear-side orientation); may identify the right side 210 as having the identification tag 104 (right-side orientation); or may identify the left side 212 as having the identification tag 104 (left-side orientation). The controller 50 uses the orientation information to control the label application system 150 for applying the shipping label 106 and the customer specific label 108 to other sides 200 of the package 102. For example, the label application system 150 may determine appropriate sides 200 to apply the shipping label 106 and the customer specified label 108 based upon which side 200 has the identification tag 104.

The label application system 150 is used to apply the labels to one or more of the sides 200 of the package 102. The controller 50 controls operation of the label application system 150. In an exemplary embodiment, the label application system 150 includes one or more labeling devices 160 configured to transfer labeling information to the package 102. In various embodiments, the labeling devices 160 may be label printers configured to print corresponding labels for the package 102. In other various embodiments, the labeling devices 160 may imprint labeling information directly on the package 102. The label application system 150 includes one or more label applicators 162 configured to apply the labeling information on the package 102, such as transferring the labels from the labeling device 160 to the package 102. The label applicators 162 are used to apply the labels to the package 102. For example, the label applicators 162 may press the labels onto the sides 200 of the packages 102.

In an exemplary embodiment, the controller 50 is operably coupled to the labeling device 160 and the label applicator 162. The controller 50 receives inputs from the package identification system 130 to determine a labeling scheme for labeling the package 102. The controller 50 determines which label to print, such as the shipping label 106, the customer specified label 108 or another type of label. The controller 50 controls operation of the labeling device 160. The controller 50 controls the labeling information, such as the information printed on the label. The controller 50 controls operation of the label applicator 162 based on the orientation of the package 102. For example, the controller 50 controls which side 200 the label applicator 162 applies the label to based on the side 200 having the identification tag 104. The controller 50 controls operation of the label applicator 162 based on the size and shape of the package 102. For example, the controller 50 determines appropriate labeling locations based on the size and shape of the package 102 and may control movements of the label applicator 162 to move to such labeling locations. The label applicator 162 is capable of applying multiple different labels on different sides of the package. The label applicator 162 is capable of applying labels to different sized boxes.

In an exemplary embodiment, the palletizing robot 20 positions the package 102 in the labeling station 110 relative to the label applicator 162 to receive the labels. In various embodiments, the palletizing robot 20 is configured to move the package 102 within the labeling station 110. For example, the package 102 may be rotated to present different sides 200 of the package 102 to the label applicator 162. The palletizing robot 20 may rotate the package 102 relative to the scanning device 132 to present the different sides 200 to the scanning device 132 to identify the side 200 having the identification tag 104. The palletizing robot 20 may then rotate the package 102 to present a different side to the label applicator 162. In alternative embodiments, the label applicator 162 may be movable relative to the package 102 to apply the labels on various sides 200 of the package 102. For example, the label applicator 162 may be a multi-axis robot having an articulating arm movable in three-dimensional space to apply the labels. In an exemplary embodiment, the label applicator 162 includes an end effector 168 provided at the end of an arm to pick up the label from the labeling device 160 and to apply the label to the side 200 of the package 102. In various embodiments, the end effector 168 may be a vacuum end effector using suction to hold the label on the end effector 168. Other types of end effectors may be used in alternative embodiments.

In an exemplary embodiment, the label application system 150 includes a label verification scanning device 170 configured to scan the labels applied to the package 102 to verify proper application of the labels. The label verification scanning device 170 may be movable to view various sides of the package 102. The label verification scanning device 170 may scan the label immediately after the label is applied, such as prior to the palletizing robot 20 moving the package 102 (either rotating the package 102 or moving the package away from the application area). The label verification scanning device 170 may include a camera configured to image the label. The label verification scanning device 170 allows for vision inspection and verification of the labels. For example, the label verification scanning device 170 may verify that the label has been applied. The label verification scanning device 170 may verify that the label is on the proper side 200 of the package 102. The label verification scanning device 170 may verify that the label is in the proper location on the package 102. The label verification scanning device 170 may verify that the label has the appropriate labeling information on the label. The label verification scanning device 170 may verify that the labeling information is legible and/or scannable. The label verification scanning device 170 may verify that the label is applied correctly and without wrinkles.

During label verification, if the label verification scanning device 170 verifies that the label is properly applied to the package 102, the palletizing robot 20 moves the package 102 to the palletizing station 80. However, if the label verification scanning device 170 determines the applied label is defective, the package 102 may be rejected. The robotic label system 100 includes a defective package transportation device 180 that transports the defective package from the labeling station 110. In various embodiments, the defective package transportation device 180 includes a conveyor 182 that transports the defective package 102*c* away from the labeling station 110. The palletizing robot 20 moves the defective package 102*c* to the defective package transportation device 180.

The robotic labeling system 100 is operated to restack the labeled packages 102 after the labels have been applied and verified that the labels are properly applied. The depalletizing, labeling and re-palletizing are completed at a single processing site. The palletizing robot 20 holds the package 102 during the entire removal, labeling and restacking process. The labeling and repalletizing is accomplished automatically using the palletizing robot 20 in a cost effective and reliable manner. The palletizing robot 20 reduces labor cost in the depalletizing, labeling, and re-palletizing process. The system is flexible in that the palletizing robot 20 is able to move and label different size and shape packages. The verification process reduces errors in the labeling process compared to user application systems.

Figure 2:
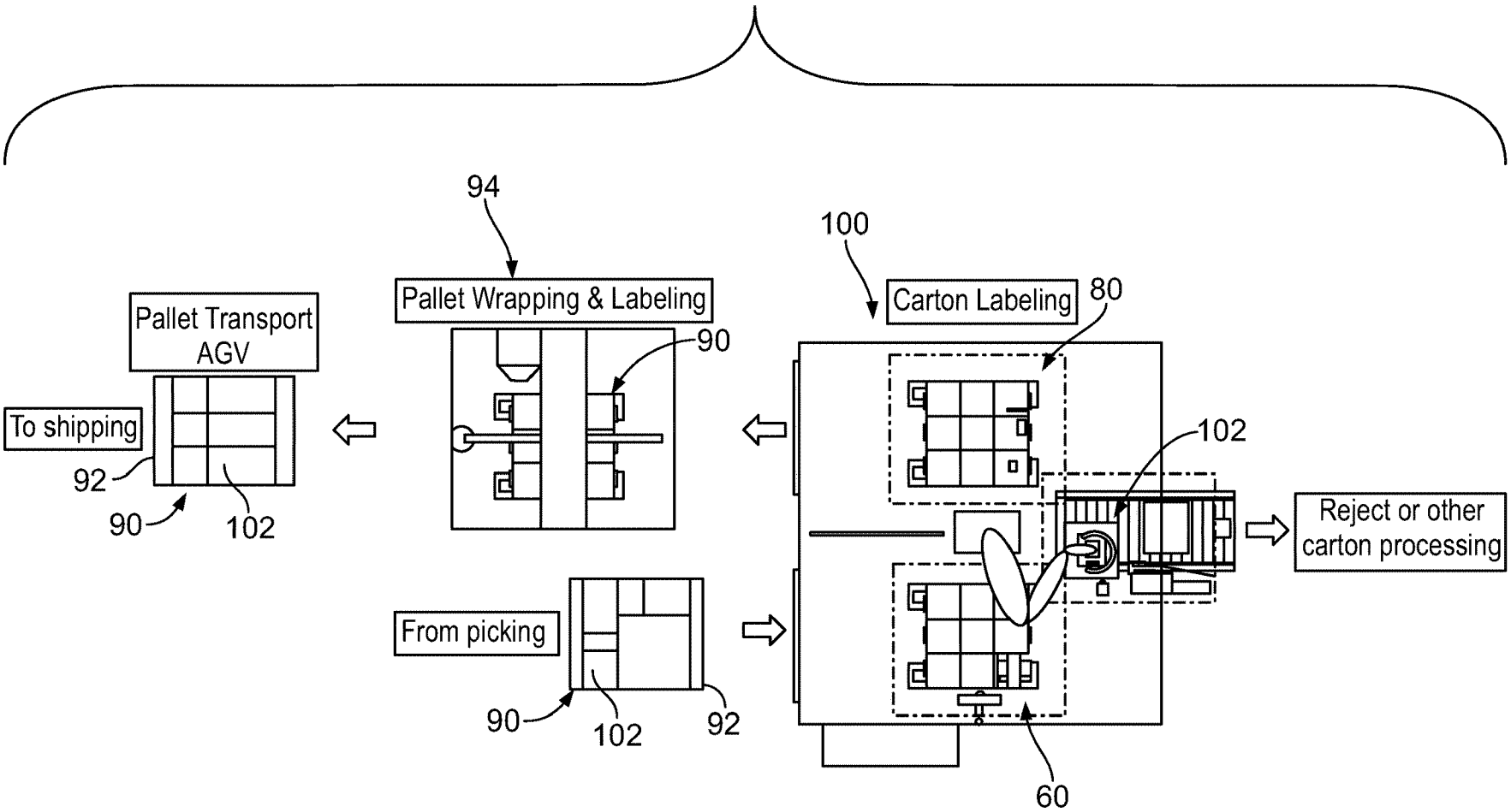
FIG. 2 illustrates the robotic labeling system in accordance with an exemplary embodiment showing additional pallets of packages.

FIG. 2 illustrates the robotic labeling system 100 in accordance with an exemplary embodiment showing additional pallets 90 of packages 102. The pallets 90 are transferred to and from the various stations using automated guided vehicles 92. For example, the automated guided vehicles 92 transfer the pallets 90 to the depalletizing station 60 and transfer the pallets 90 from the palletizing station 80, such as to a pallet wrapping station 94.

Figure 3:
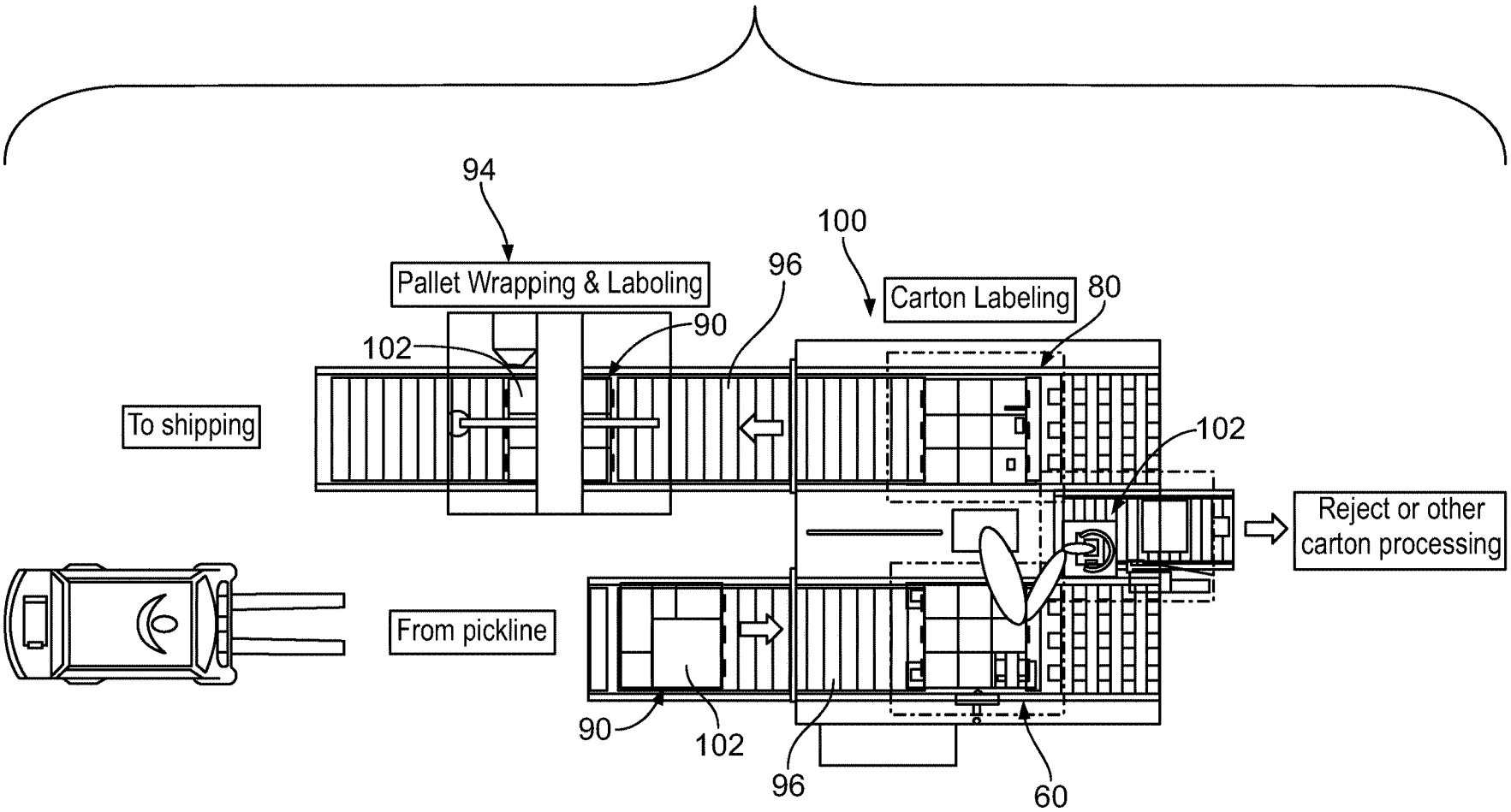
FIG. 3 illustrates the robotic labeling system in accordance with an exemplary embodiment showing the additional pallets of packages.

FIG. 3 illustrates the robotic labeling system 100 in accordance with an exemplary embodiment showing the additional pallets 90 of packages 102. The pallets 90 are transferred to and from the various stations using conveyors 96. For example, the conveyors 96 transfer the pallets 90 to the depalletizing station 60 and the conveyors 96 transfer the pallets 90 from the palletizing station 80 to the pallet wrapping station 94.

Figure 4:
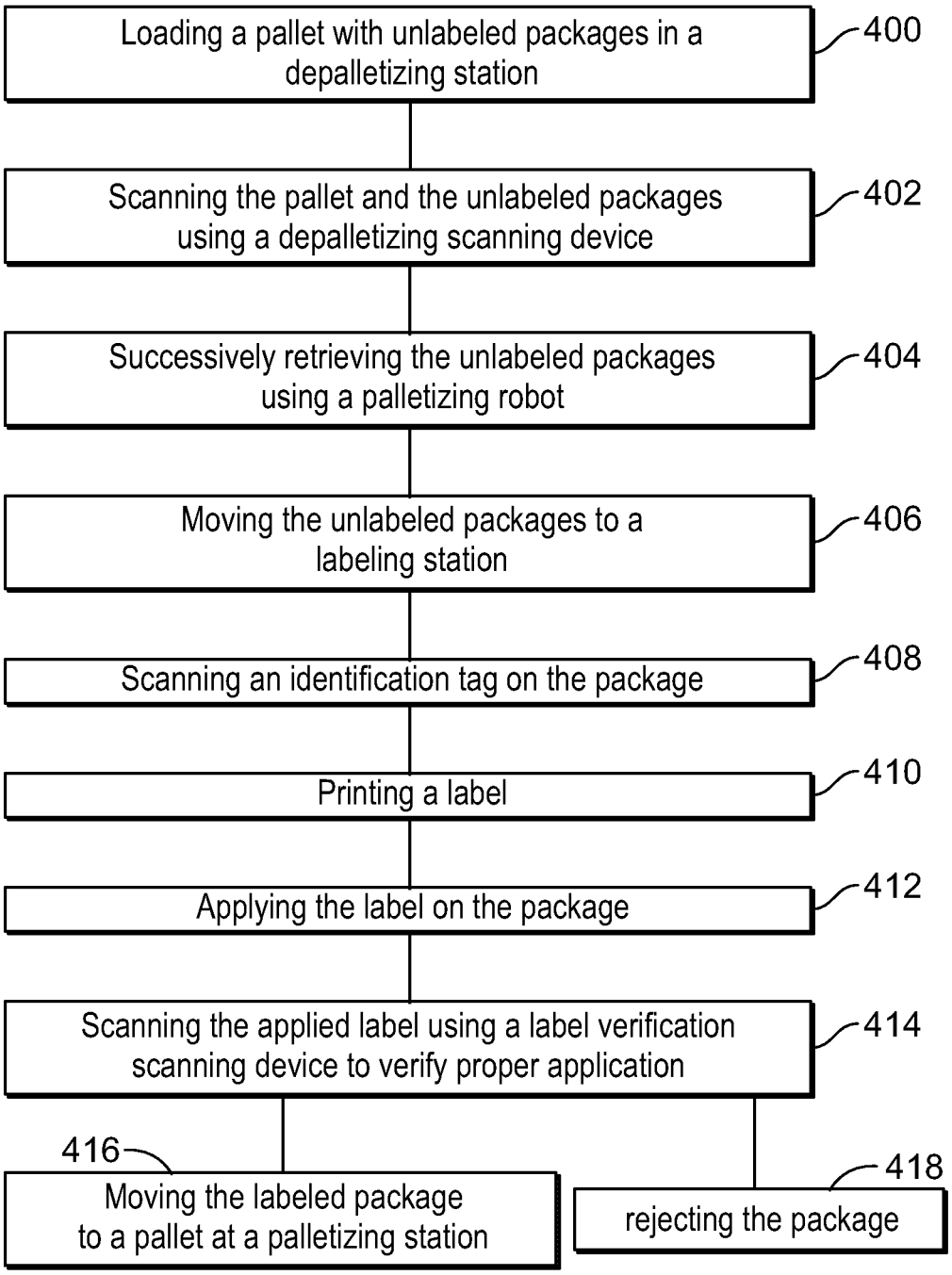
FIG. 4 is a flowchart of a method of labeling a package in accordance with an exemplary embodiment.

FIG. 4 is a flowchart of a method of labeling a package in accordance with an exemplary embodiment. Various steps may be omitted and the order of the steps may be altered in various alternative embodiments. The method includes loading 400 a pallet that holds a plurality of unlabeled packages in a depalletizing station. The depalletizing station may be located adjacent to a palletizing robot that is used to pick and move the packages from the pallet. The depalletizing station may be located adjacent to a labeling station where labels may be applied to the packages prior to the packages being restacked on a pallet in a palletizing station located near the depalletizing station. The pallet may be loaded by a handcart, a forklift, an automated guided vehicle, a conveyor or other device. The pallet may be loaded onto a rack to position the pallet in the depalletizing station.

The method includes scanning 402 the pallet and the unlabeled packages at the depalletizing station using a depalletizing scanning device. The depalletizing scanning device identifies sizes, shapes and locations of the packages. The depalletizing scanning device may send signals or data to a controller which is used to control the palletizing robot. In various embodiments, the depalletizing scanning device may include a camera used to image the packages for vision inspection of the packages. The depalletizing scanning device scans the locations of the packages to control operation of the palletizing robot.

The method includes successively retrieving 404 the unlabeled packages from the depalletizing station using the palletizing robot and moving 406 the unlabeled packages from the depalletizing station to the labeling station adjacent to the depalletizing station. The palletizing robot is controlled by the system controller. The palletizing robot is controlled based on the data from the depalletizing scanning device. The palletizing robot may use a vacuum or suction to hold the package. Alternatively, the palletizing robot may include a gripper or other device to hold the package. The palletizing robot is movable in three-dimensional space to move the package from the pallet to the labeling station. The package may be rotated, tilted, translated or otherwise moved to an appropriate position in the labeling station for label application.

The method includes scanning 408 an identification tag on the package using a scanning device to determine a package identification of the package and an orientation of the package in the labeling station. The identification tag is used to identify the particular package (for example, compared to other packages) with reference to the package database. The identification tag is a unique identifier for the package, such as being a scannable tag, such as a barcode, a data matrix, a QR code, or another type of symbolic scan code. Information about the package may be associated with the identification tag, such as shipping information. The scanning step is used to identify the side of the package that has the identification tag to determine the orientation of the package. For example, the scanning device may identify the top side as having the identification tag (top-side orientation); may identify the front side as having the identification tag (front-side orientation); may identify the rear side as having the identification tag (rear-side orientation); may identify the right side as having the identification tag (right-side orientation); or may identify the left side as having the identification tag (left-side orientation). The controller uses the orientation information to control the label application process, such as to determine appropriate sides to apply other labels.

The method includes preparing a label, such as printing 410 a label at a labeling device for the package based on the package identification and applying 412 the label to the package using a label applicator based on the package orientation in the labeling station. The label application system may print a shipping label, a customer specific label, and the like. The labels are applied to the package by the label application system at the labeling station. In an exemplary embodiment, the labels are applied to any of the sides of the package that does not include the identification tag. In various embodiments, the label application system only applies one label to any particular side so the labels do not overlap and are easily identifiable. In various embodiments, the palletizing robot moves the package within the labeling station to position the package relative to the label applicator. For example, the palletizing robot may rotate the package to present different sides of the package to the label applicator.

After the label(s) is applied to the package, the method includes scanning 414 the applied label using a label verification scanning device to verify proper application of the label. The label verification scanning device may be movable to view various sides of the package. The label verification scanning device may include a camera configured to image the label. The label verification scanning device may verify that the label has been applied. The label verification scanning device may verify that the label is on the proper side of the package. The label verification scanning device may verify that the label is in the proper location on the package. The label verification scanning device may verify that the label has the appropriate information printed on the label. The label verification scanning device may verify that the information printed is legible and/or scannable. The label verification scanning device may verify that the label is applied correctly and without wrinkles.

During label verification, if the label verification scanning device verifies that the label is properly applied to the package, the method includes moving 416 the labeled package from the labeling station to a pallet at the palletizing station adjacent to the labeling station after label verification. As such, the palletizing robot is used to restack the labeled packages after the labels have been applied and verified that the labels are properly applied. The depalletizing, labeling and re-palletizing are completed at a single processing site. The palletizing robot holds the package during the entire removal, labeling and restacking process. The labeling and repalletizing is accomplished automatically using the robotic labeling system in a cost effective and reliable manner. The palletizing robot reduces labor cost in the depalletizing, labeling, and re-palletizing process. The system is flexible in that the palletizing robot is able to move and label different size and shape packages. The verification process reduces errors in the labeling process compared to user application systems.

During label verification, if the label verification scanning device determines the applied label is defective, the method includes rejecting 418 the package. The palletizing robot rejects the package by moving the package to a location other than the pallet at the palletizing station. For example, the palletizing robot may transfer the package to a defective package transportation device that transports the defective package away from the labeling station. For example, a conveyor may transports the defective package away from the labeling station. The package may be further processed after being rejected, such as to cure the defect.

Figure 5:
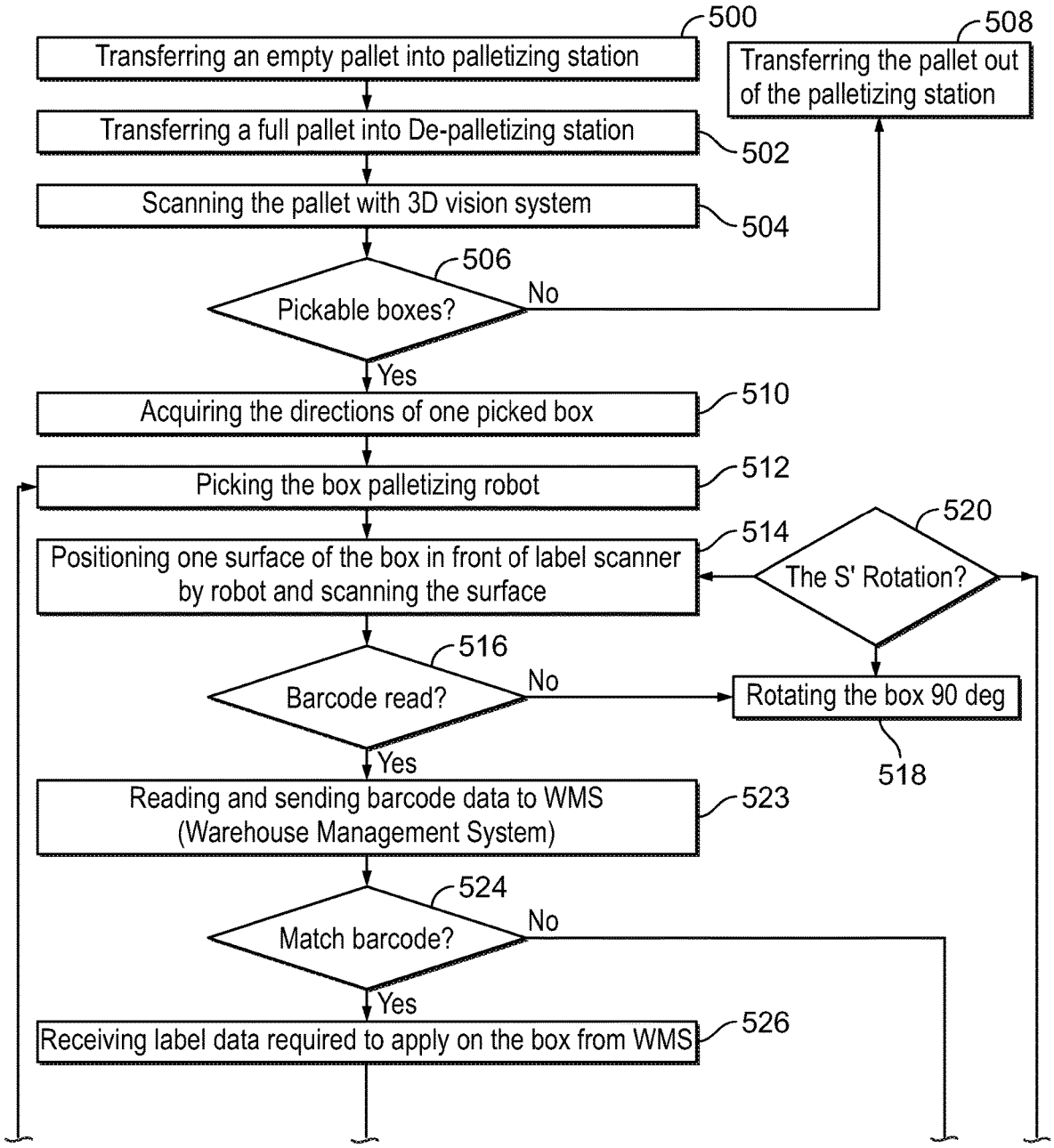
FIG. 5 is a flowchart of a method of labeling packages in accordance with an exemplary embodiment.
Figure 5:
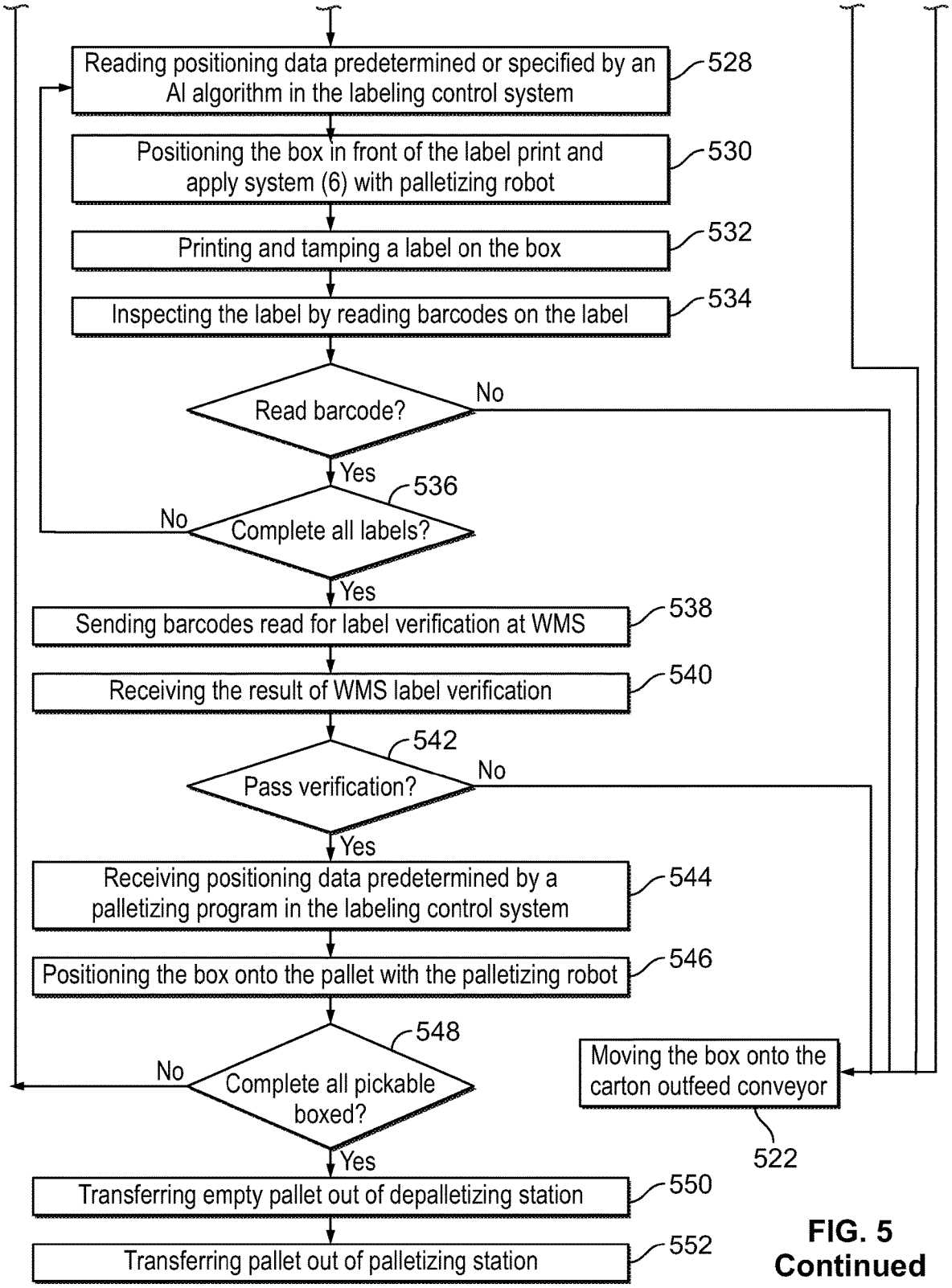

FIG. 5 is a flowchart of a method of labeling packages in accordance with an exemplary embodiment. The steps are an exemplary method of labeling a package. Various steps may be omitted and the order of the steps may be altered in various alternative embodiments.

The method includes transferring 500 an empty pallet into a palletizing station and transferring 502 a full pallet with unlabeled packages into a depalletizing station. The packages may be boxes in various embodiments. The method includes scanning 504 the full pallet and the unlabeled packages at the depalletizing station using a depalletizing scanning device. The depalletizing scanning device may be a 3D vision system. The depalletizing scanning device may include a camera used to image the packages for vision inspection of the packages. The depalletizing scanning device identifies sizes, shapes and locations of the packages. The depalletizing scanning device may send signals or data to a controller which is used to analyze the data to control the palletizing robot. The controller determines 506 if the packages are pickable packages. If the packages are not pickable, the method includes transferring 508 the pallet out of the palletizing station. If the packages are pickable, the method includes acquiring 510 the dimensions of one of the packages. The dimensions may be determined based on the image, such as using sizing software. The dimensions may be acquired from a package database. In various embodiments, the dimensions may be determined prior to determining 506 if the packages are pickable. For example, the packages may be determined as being pickable based on the dimension of the packages. For example, the system may be configured to only handle the boxes below certain dimensions, such as below 24 inches in height. If the height is more than such maximum dimension, then the pallet will not be handled in the particular station.

The method includes picking 512 the package from the pallet using the palletizing robot. The palletizing robot may pick the package using a vacuum end effector or a gripper. The package is moved to a labeling station by the palletizing robot. The method includes positioning 514 one side of the package in front of a scanning device and scanning the side of the package using the scanning device. The system controller determines 516 if an identification tag is identified. For example, the identification tag may be a barcode and the system controller determines if the barcode has been scanned. If no identification tag is identified, the method includes rotating 518 the package 90°. The palletizing robot holds the package and is able to rotate the package in the labeling station. The package is rotated 90° to position a different side in front of the scanning device. Once the package has been rotated, the controller determines 520 if the rotation is the fifth rotation (for example, all four sides have been scanned). If the rotation is the fifth rotation, the method continues to step 522 to move the package to the package transportation device to transfer the package out of the labeling station. The package is assumed to be defective. For example, the package does not include an identification tag and therefore cannot be labeled and re-palletized. If the rotation is not the fifth rotation, the method returns to step 514 with the new side positioned in front of the scanning device.

During processing, at step 516, if the system controller identifies an identification tag, the method includes reading 523 the identification tag and sending identification data to a warehouse management system to compare the identification tag to the list of identification tags in the package database. The system controller determines 524 if the identification tag matches an identification tag in the package database. If the identification tag does not match any identification tag in the package database, the method continues to step 522 to move the package to the package transportation device to transfer the package out of the labeling station. The package is assumed to be defective.

At step 524, if the system controller determines that the identification tag matches an identification tag in the package database, the method includes receiving 526 label data from the warehouse management system. The method includes receiving 528 positioning data for the label, which may be predetermined or specified by an AI algorithm in the system controller. For example, the AI algorithm may determine an appropriate label position based on the size and the shape of the package (for example, determined by the depalletizing scanning device). The method includes positioning 530 the package in front of the label application system, such as the label applicator. The package is positioned by the palletizing robot.

At step 532, the method includes printing a label and applying the label on the package. The label is printed by the labeling device and applied to the package by the label applicator. The label applicator may press the label against the side of the package. After the label is applied, the method includes inspecting 534 the label using a label verification scanning device. The label may include a barcode and the label verification scanning device may be a barcode reader. If the label verification scanning device is unable to read or scan the label (for example, the barcode cannot be read), the method continues to step 522 to move the package to the package transportation device to transfer the package out of the labeling station. The package is assumed to be defective. However, if the label verification scanning device is able to read or scan the label, the system controller determines 536 if all of the labels have been applied. If all of the labels have not been applied, the method returns to step 528 to receive positioning data for the additional labels.

Once all of the labels have been applied, the method includes sending 538 the label codes that have been scanned for label verification at the warehouse management system. The system controller then receives 540 the result of the label verification and determines 542 is the package passes verification. If the package does not pass verification, the method continues to step 522 to move the package to the package transportation device to transfer the package out of the labeling station. The package is assumed to be defective. However, if the package passes verification, the method includes receiving 544 positioning data predetermined by a palletizing program and positioning 546 the package on the pallet at the predetermined position using the palletizing robot. The system controller determines 548 if all of the packages have been picked. If there are packages that still need to be picked, the method continues back to step 512 to pick the next package. However, if all of the packages have been picked the method includes transferring 550 the empty pallet out of the depalletizing station and transferring 552 the pallet out of the palletizing station.

The robotic labeling system is thus operated to restack the labeled packages after the labels have been applied and verified that the labels are properly applied. The depalletizing, labeling and re-palletizing are completed at a single processing site. The labeling and repalletizing is accomplished automatically using the palletizing robot in a cost effective and reliable manner. The method is automated to reduce labor cost in the depalletizing, labeling, and re-palletizing process. The method is flexible in that the palletizing robot is able to move and label different size and shape packages. The verification process reduces errors in the labeling process compared to user application systems.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A robotic labeling system for labeling packages on a pallet comprising:

a depalletizing station having a space for a pallet holding a plurality of unlabeled packages;

a palletizing station having a space for a pallet configured to receive a plurality of labeled packages;

a labeling station adjacent to the depalletizing station and the palletizing station, the labeling station configured to successively receive the packages for labeling, the labeling station having a labeling device preparing labels for the packages and a label applicator applying the label to the corresponding packages, the labeling station including a label verification scanning device scanning the applied labels at the labeling station for label verification; and a palletizing robot including a multi-axis robot having an articulating arm that moves in three-dimensional space and an end effector provided at the end of the articulating arm to pick up the packages and move the packages in three-dimensional space, the palletizing robot moving the unlabeled packages from the depalletizing station to the labeling station for label application, the palletizing robot holding the package in the labeling station relative to the label verification scanning device during scanning of the applied labels at the labeling station, and the palletizing robot moving the labeled packages from the labeling station to the palletizing station after label verification, wherein the palletizing robot does not move the labeled packages to the palletizing station if the package fails label verification.

2. The robotic labeling system of claim 1, wherein the palletizing robot holds the package in the labeling station at a predetermined position during label application.

3. The robotic labeling system of claim 1, wherein the labeling station includes a scanning device scanning the package for an identification tag on a side of the package, the label applicator applying the label to a different side of the package.

4. The robotic labeling system of claim 3, wherein the labeling device retrieves shipping data from a package database based on the identification tag to prepare a shipping label.

5. The robotic labeling system of claim 3, wherein the palletizing robot rotates the package in the labeling station relative to the scanning device to present the side with the identification tag to the scanning device.

6. The robotic labeling system of claim 1, wherein the labeling device is a label printer configured to print the labels for the packages.

7. The robotic labeling system of claim 1, wherein the palletizing robot is located between the depalletizing station and the palletizing station.

8. The robotic labeling system of claim 1, wherein the labeling station includes a defective package transportation device, the palletizing robot moving the package to the defective package transportation device when the label verification scanning device determines the package is defective.

9. The robotic labeling system of claim 1, wherein the depalletizing station includes a depalletizing scanning device scanning the pallet and the unlabeled packages at the depalletizing station.

10. The robotic labeling system of claim 9, wherein the depalletizing scanning device scans locations and dimensions of the unlabeled packages on the pallet to control operation of the palletizing robot to retrieve the unlabeled package.

11. The robotic labeling system of claim 1, wherein the label verification scanning device reads a barcode on the label for label validation.

12. The robotic labeling system of claim 1, wherein the labeling station applies multiple labels to each package, the label verification scanning device scanning each of the labels for label verification.

13. The robotic labeling system of claim 1, wherein the palletizing robot receives positioning data from a palletizing program to identify a predetermined position on the pallet in the palletizing station to position the labeled package.

14. A robotic labeling system for labeling packages on a pallet comprising:

a depalletizing station having a space for a pallet holding a plurality of unlabeled packages;

a palletizing station having a space for a pallet configured to receive a plurality of labeled packages;

a labeling station adjacent to the depalletizing station and the palletizing station, the labeling station configured to successively receive each package for labeling, the labeling station including a package identification system having a scanning device configured to scan an identification tag on the package to determine a package identification of the package and an orientation of the package in the labeling station, the labeling station including a label application system having a labeling device and a label applicator, the labeling device preparing a label for the package based on the package identification, the label applicator applying the label to the package based on the package orientation, the labeling station including a label verification scanning device scanning the applied label at the labeling station for label verification; and a palletizing robot including a multi-axis robot having an articulating arm that moves in three-dimensional space and an end effector provided at the end of the articulating arm to pick up the packages and move the packages in three-dimensional space, the palletizing robot moving the unlabeled packages from the depalletizing station to the labeling station for label application, the palletizing robot holding the package in the labeling station relative to the label verification scanning device during scanning of the applied labels at the labeling station, and the palletizing robot moving the labeled packages from the labeling station to the palletizing station after label verification, wherein the palletizing robot does not move the labeled packages to the palletizing station if the package fails label verification.

15. The robotic labeling system of claim 14, wherein the labeling device retrieves shipping data from a package database based on the identification tag to print a shipping label.

16. The robotic labeling system of claim 14, wherein the palletizing robot rotates the package in the labeling station relative to the scanning device to present the side with the identification tag to the scanning device.

17. The robotic labeling system of claim 14, wherein the labeling station includes a defective package transportation device, the palletizing robot moving the package to the defective package transportation device when the label verification scanning device determines the package is defective.

18. The robotic labeling system of claim 14, wherein the depalletizing station includes a depalletizing scanning device scanning the pallet and the unlabeled packages at the depalletizing station, the depalletizing scanning device scans locations and dimensions of the unlabeled packages on the pallet to control operation of the palletizing robot to retrieve the unlabeled package.

19. A method of labeling packages on a pallet comprising:

loading a pallet in a depalletizing station, the pallet holding a plurality of unlabeled packages;

scanning the pallet and the unlabeled packages at the depalletizing station using a depalletizing scanning device;

successively retrieving the unlabeled packages from the depalletizing station using a palletizing robot including a multi-axis robot having an articulating arm that moves in three-dimensional space and an end effector provided at the end of the articulating arm to pick up the packages and move the packages in three-dimensional space;

moving the unlabeled packages from the depalletizing station to a labeling station adjacent to the depalletizing station using the palletizing robot;

scanning an identification tag on the package using a scanning device to determine a package identification of the package and an orientation of the package in the labeling station;

preparing a label at a labeling device for the package based on the package identification;

applying the label using a label applicator while the palletizing robot holds the package relative to the label applicator based on the package orientation in the labeling station;

scanning the applied label at the labeling station using a label verification scanning device while the palletizing robot holds the package relative to the label verification scanning device to verify proper application of the label; and moving the labeled package using the palletizing robot from the labeling station to a pallet at a palletizing station adjacent to the labeling station after label verification, wherein the package is not moved to the palletizing station if the package fails label verification.

20. The method of claim 19, wherein said moving the unlabeled packages from the depalletizing station to the labeling station comprises rotating the unlabeled package to scan different sides of the unlabeled package until the identification tag is scanned.

21. The method of claim 19, further comprising removing defective packages from the labeling station to a location remote from the palletizing station.

22. The method of claim 19, wherein said preparing the label comprises printing the label at a label printer defining the labeling device.

* * * * *